US006101727A

United States Patent [19]

Chong

[11] Patent Number: 6,101,727

[45] **Date of Patent: *Aug. 15, 2000**

[54] HAND PUMP-ACTION CAN OPENER

[76] Inventor: Wun C. Chong, 69 Wallace Place, Delta, B.C., Canada, V4M 3S2

[ * ] Notice: This patent issued on a continued prosecution application filed under 37 CFR 1.53(d), and is subject to the twenty year patent term provisions of 35 U.S.C. 154(a)(2).

[21] Appl. No.: 09/075,347

[22] Filed: May 11, 1998

[51] Int. Cl.[7] ..... B67B 7/46

[52] U.S. Cl. ..... 30/418; 30/417; 30/422; 30/427

[58] Field of Search ..... 30/418, 419, 422, 30/424, 425, 427, 417

[56] References Cited

U.S. PATENT DOCUMENTS

| | | | |
|---|---|---|---|
| Re. 27,504 | 10/1972 | Smith | 30/418 |
| 1,935,680 | 11/1933 | Von Wolforsdorf | 30/417 |
| 2,718,056 | 9/1955 | Burnett | 30/422 |
| 3,510,941 | 5/1970 | Fyfe | 30/417 |
| 3,719,991 | 3/1973 | French | 30/417 |
| 3,730,391 | 5/1973 | O'Bannon | 222/82 |
| 4,050,155 | 9/1977 | Pitocchi | 30/400 |
| 4,365,417 | 12/1982 | Rosendahl | 30/422 |
| 4,782,594 | 11/1988 | Porucznik et al. | 30/417 |
| 5,022,159 | 6/1991 | Cressman et al. | 30/418 |
| 5,121,546 | 6/1992 | Chong | 30/418 |
| 5,291,658 | 3/1994 | Wilson et al. | 30/418 |
| 5,347,720 | 9/1994 | Pereira | 30/422 |
| 5,367,776 | 11/1994 | Chong | 30/417 |

*Primary Examiner*—M. Rachuba
*Assistant Examiner*—Stephen Choi
*Attorney, Agent, or Firm*—Oyen Wiggs Green & Mutala

[57] ABSTRACT

A dual-handle pump-action can opener that can be operated by either hand and cuts the exterior wall of the seam of a can, rather than the top lip of the can. The dual-handle pump-action can opener includes: (a) a housing having a first handle; (b) a cutting wheel associated with the housing and the first handle and having a cutting edge for severing the exterior wall of the can seam; (c) a traction wheel associated with the housing and the first handle and having a gripping surface for engaging the interior wall of the can seam; and (d) a second handle which is movable towards and away from the first handle. When the second handle is initially moved towards the first handle after the can opener is installed on the seam of the can, it causes the traction wheel to contact the interior wall of the can seam and the cutting wheel to contact the exterior wall of the can seam. On subsequent reciprocal movement of the second handle towards and away from the first handle through a series of levers and gears, the traction wheel is caused to rotate in incremental steps to advance the traction wheel along the interior wall of the can seam, thereby causing the cutting wheel also to rotate and cut the exterior wall of the can seam.

11 Claims, 4 Drawing Sheets

HAND PUMP-ACTION CAN OPENER

FIELD OF THE INVENTION

This invention relates to a novel can opener. More particularly, the invention is directed to a novel pump-action can opener that can be operated by either hand and cuts the outer seam wall of a can, rather than the top lid of the can.

BACKGROUND OF THE INVENTION

Can openers are well known. In general, they comprise a traction wheel and a cutting wheel. One wheel can be rotated and the traction wheel acts as a reaction surface and also acts to drive the can opener around the lip of the can while the sharpened cutting wheel cuts through the can. The most popular type of can opener available is the type that cuts the top lid of the can to gain access to the can contents. The main problem with this mode of opening is that the cutting blade cuts down through the lid and tends to come into contact with the contents of the can. This is a problem if the cutting blade is dirty from previous use. If the cutting blade is not particularly sharp, it will tend to form small metal shavings that fall into and contaminate the contents of the can. If the entire circumference of the can lid is cut, the top lid often falls into the can contents and can be difficult and messy to remove from the interior of the can.

To address these problems, can openers have been developed that are designed to cut the outside seam of the can. Examples of these can openers include U.S. Pat. No. 3,719,991 to French; U.S. Reissued Pat. No. 27,504 to Smith; U.S. Pat. No. 1,935,680 to Von Wolforsdorf; U.S. Pat. No. 4,782,594 to Porucznik et al. and U.S. Pat. No. 3,510,941 to Fyfe. All these patents disclose a can including a pin sliding in an arcuate slot for engaging and locking the can opener on the can to be opened. While these arrangements work adequately, over time there is a tendency for the moving parts to wear with the result that the engaging and locking function of the opener is impaired leading to difficulty in cutting the can and keeping the opener in position on the can.

My own U.S. Pat. No. 5,121,546, granted Jun. 16, 1992, discloses an effective solution of the above problem. In the can opener disclosed in that patent, there are thrust surfaces and a separating means that can be introduced between the thrust surfaces. The separating means, typically a ball bearing, is introduced between the thrust surfaces and moves a movable thrust surface away from a fixed thrust surface to separate a movable wheel, usually the traction wheel, and a cutting wheel. By this means, the can opener is brought to the cutting position. The wheel can then be rotated to cut the can. While the can opener disclosed in my U.S. Pat. No. 5,121,546 has proved to be extremely effective, experiments with groups of people have shown that a certain dexterity is required in order to effectively operate the can opener. Such dexterity is not always present because many persons opening cans do not have a great deal of dexterity.

My second U.S. Pat. No. 5,367,776, granted Nov. 29, 1994, discloses a can opener comprising a housing having a handle. The cutting wheel has a cutting edge for severing a can wall, the cutting wheel defining a cutting wheel axis. The opener also has a traction wheel having a gripping surface which engages a can, the traction wheel defining a traction wheel axis. The opener also includes means for rotatably mounting the traction wheel and the cutting wheel in the housing such that their axes are substantially perpendicular and the wheels are positioned adjacent and spaced apart from each other to define a gap to accept the seam of the can to be opened. One of the wheels is movable towards the other in order to engage and lock the can between the cutting wheel and the traction wheel so that the cutting wheel acts to sever the can wall. The traction wheel acts to move the can past the cutting wheel. A first thrust surface is associated with the housing and a spaced, adjacent, second thrust surface is associated with the moveable wheel. The first and second thrust surfaces comprise cooperable cam surfaces which are rotatable relative to each other to reciprocate the first and the second thrust surfaces relative to each other between a first position, where the gap is relatively wide, and a second position where the gap is narrow and the can is engaged and locked between the cutting wheel and the traction wheel. Means are associated with one of the wheels to permit rotation thereof.

SUMMARY OF THE INVENTION

The invention is directed to a pump-action can opener comprising: (a) a housing having a first handle; (b) a cutting wheel having a cutting edge for severing a can wall, the cutting wheel defining a cutting wheel axis; (c) a traction wheel having a gripping surface for engaging a can, the traction wheel defining a traction wheel axis; (d) a second handle which is moveable towards and away from the first handle, the second handle, when moved towards the first handle, causing the traction wheel to grip and advance along the can wall and thereby cause the cutting wheel to cut the can wall.

The can opener can include a release mechanism which can release engagement between the second handle and the traction wheel, to thereby enable the second handle to move away from the first handle without causing the traction wheel to advance or retreat along the can wall. The moveable second handle can engage the traction wheel by a plurality of levers and gears.

The can opener can include a traction wheel gear and a pump handle gear, which can have different diameters to thereby provide a mechanical advantage when the second pump handle is moved towards the first fixed handle.

The levers of the moveable second handle can engage a ratchet wheel when the second handle is moved towards the first handle, and release from the ratchet wheel when the second handle is moved away from the first handle.

The can opener can include a manual release mechanism which can release engagement between the traction wheel, the cutting wheel and the can when the release mechanism is activated.

The can opener can include means rotatably mounting the traction wheel and the cutting wheel in the housing such that the axes of the traction wheel and the cutting wheel are substantially perpendicular, the wheels being positioned adjacent and spaced apart from each other to define a gap to accept a can to be opened, one of the wheels being movable towards the other to engage and lock the can between the cutting wheel and the traction wheel so that the cutting wheel acts to sever the can wall and the traction wheel acts to move the can past the cutting wheel; a first thrust surface associated with the housing and a spaced, adjacent, movable second thrust surface associated with the traction wheel; the first and second thrust surfaces comprising cooperable surfaces rotatable relative to each and being formed with at least one ball and at least one ball race, the first and second thrust surfaces defining a first position where the can is engaged and locked between the cutting wheel and the traction wheel, and a second position where the gap is widened to enable the can to be released.

The axis for the cutting wheel and the axis for the traction wheel can comprise a pair of spindle shafts rotatably mounted in the housing, one spindle shaft for each of the wheels.

The cutting wheel can be adapted to engage one side of a seam wall of a can and the traction wheel can be adapted to engage an opposite side of the seam wall of the can. The cutting wheel can engage the exterior side of the seam wall.

The can opener can include an abutment member for guiding the movement of the can opener about the can during the cutting operation. The abutment member can have a downwardly curved U-shape adapted to engage with a top seam edge of the can and extend downwardly towards a lid of the can. The axis of said cutting wheel can be positioned at an angle with respect to the plane of the top of the can.

In the can opener, the second thrust surface can have thereon a lug projection, the second thrust surface and the lug projection being rotated to the first position when the second handle is initially moved towards the first handle, and a releasable lock engages the lug projection to told it in the first position. The lug projection can have thereon a plurality of locking positions. The releasable lock can engage one of the locking positions and cause connected to a manual release mechanism. The releasable lock can engage a second mechanism which engages the lug projection and when the releasable lock is released, the second mechanism moves the second thrust surface to the second thrust position.

The can opener can include four balls and four ball races, the bottoms of the races being sloped so that the first and second thrust surfaces move towards or away from one another as the balls move along the races. The lug projection can be moved to the first position by a lever associated with the moveable second handle, the locking positions can be grooves in the surface of the lug projection and the releasable lock can have a trigger which engages one of the grooves. In the can opener the first and second handles can be replaced by a motor mechanism which drives the traction wheel.

BRIEF DESCRIPTION OF THE DRAWINGS

In drawings which illustrate specific embodiments of the invention, but which should not be construed as restricting the spirit or scope of the invention in any way.

DESCRIPTION OF PREFERRED EMBODIMENTS OF THE INVENTION

The can opener according to the present invention utilizes some of the seam cutting components which were disclosed and illustrated in my prior U.S. Pat. No. 5,367,776, granted Nov. 29, 1994. However, the invention that is disclosed and claimed herein has a number of major advantages over the can opener that is disclosed in my prior U.S. Pat. No. 5,367,776. Instead of a single finger twist handle, the can opener according to the invention includes a stationary handle and a pump-action handle which can be held easily in the hand and operated by either the left hand or the right hand. Furthermore, the pump-action can opener according to the invention automatically engages the seam of the can by squeezing the moveable pump-action handle. The can opener according to the invention cuts the seam of the can on the exterior side, similar to the manner in which my prior can opener designs cut the exterior side seam of the can. However, with the present invention, the traction wheel and cutting wheel proceed around the circumference of the can seam, and cut it, by having the operator conduct a series of reciprocating pump action hand clenches and releases. The pump-action can opener according to the invention is disengaged from the can seam, once the entire seam has been cut, by pushing a release button at the top rear of the opener. The pump-action can opener according to the invention also includes a U-shaped, downwardly depressed can abutment member which at its distal end descends below the elevation of the can seam, and assists in aligning the opener on the can so that an accurate and clean cut can be made and also assists in holding the can and seam in engagement with the pump-action can opener.

Figure 1:
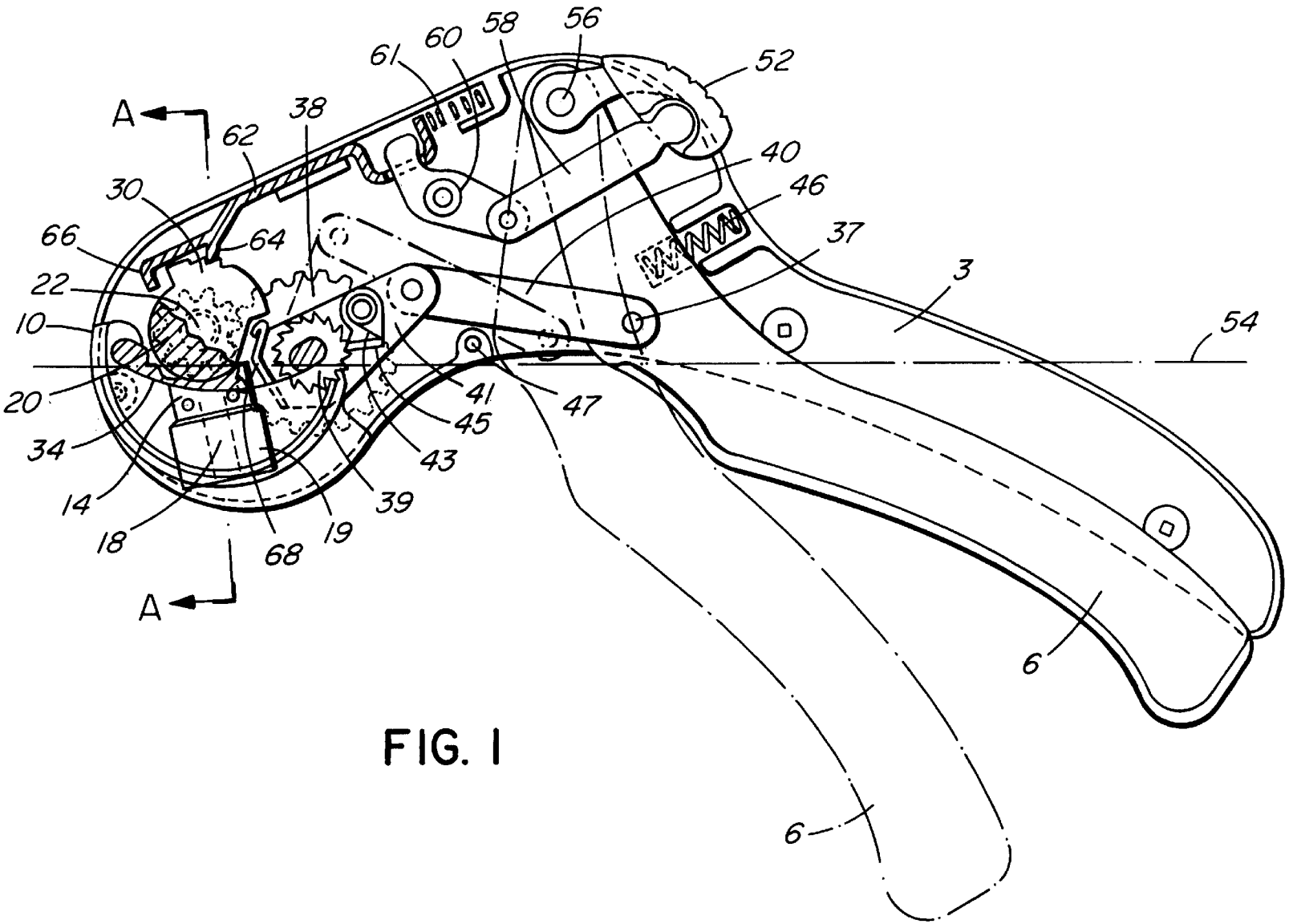
FIG. 1 illustrates a front elevation section view of the pump-action can opener.
Figure 5:
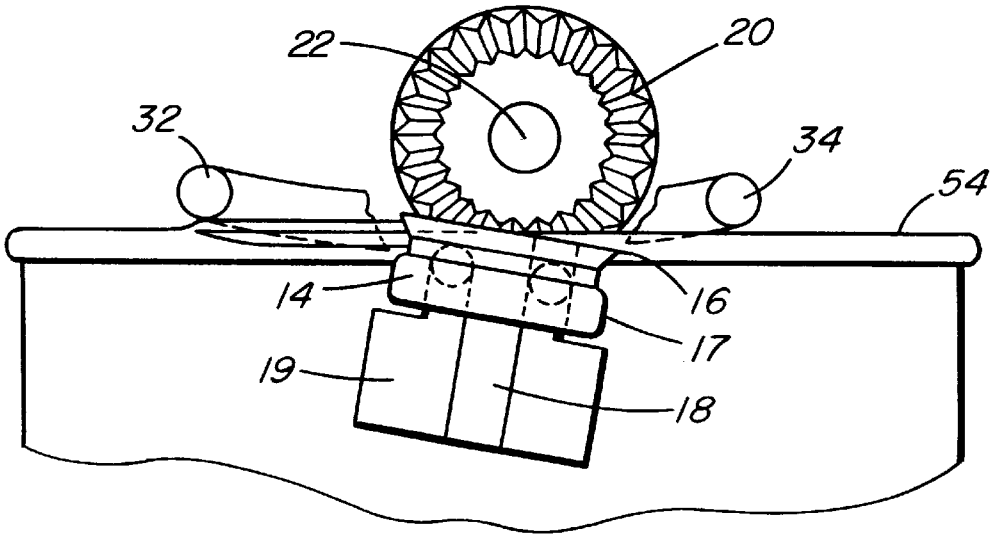
FIG. 5 illustrates a detail side view of a traction wheel and cutting wheel cutting a seam of a can.

The drawings, and particularly FIG. 1, which illustrates a front elevation section view of the pump-action can opener, show a can opener 2 comprising a housing 10 having a pistol-like pump-action handle comprising a fixed stationary handle 3 and a moveable pump handle 6. A cutting wheel 14 with a cutting edge 16 for severing the exterior side top seam 54 of a can wall 4, is shown in FIGS. 1, 3 and 5. The cutting wheel 14 is mounted on a rotatable spindle shaft 18 that defines a cutting wheel axis. A traction wheel 20 has a can seam gripping surface in the form of teeth as shown particularly in FIGS. 2 and 3. The traction wheel 20 is mounted on a second rotatable spindle shaft 22 that defines a traction wheel axis. The cutting wheel 14 and traction wheel 20 are mounted in housing 10 so that spindle shafts 18 and 22, and thus the axes of rotation of wheels 14 and 22, are substantially perpendicular and the cutting and traction wheels are positioned adjacent but spaced from each other to define a gap 24 (see FIG. 3) which is able to accept the can seam 54 of the can 4 to be opened.

Figure 2:
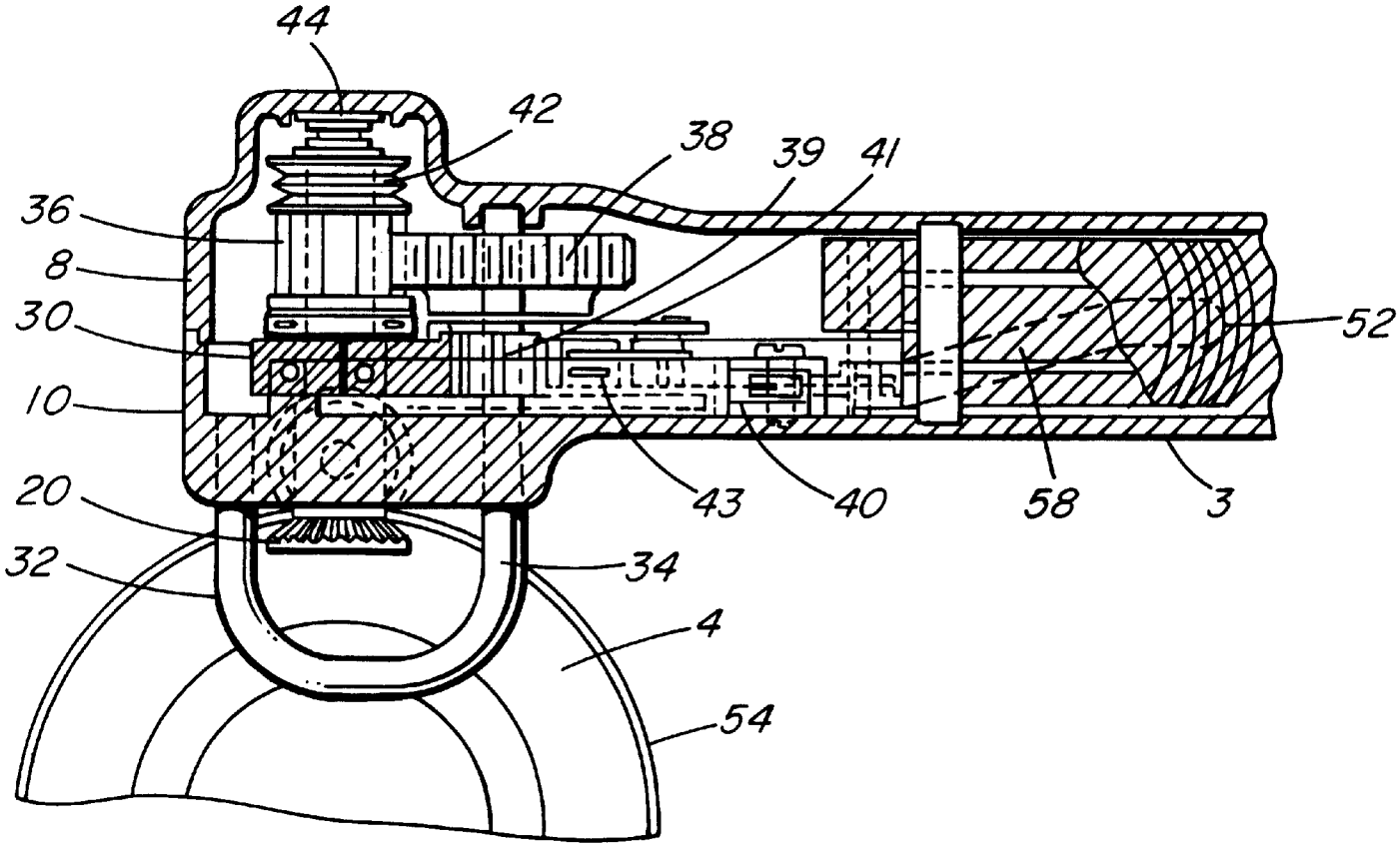
FIG. 2 illustrates a plan section view of the pump-action can opener.
Figure 3:
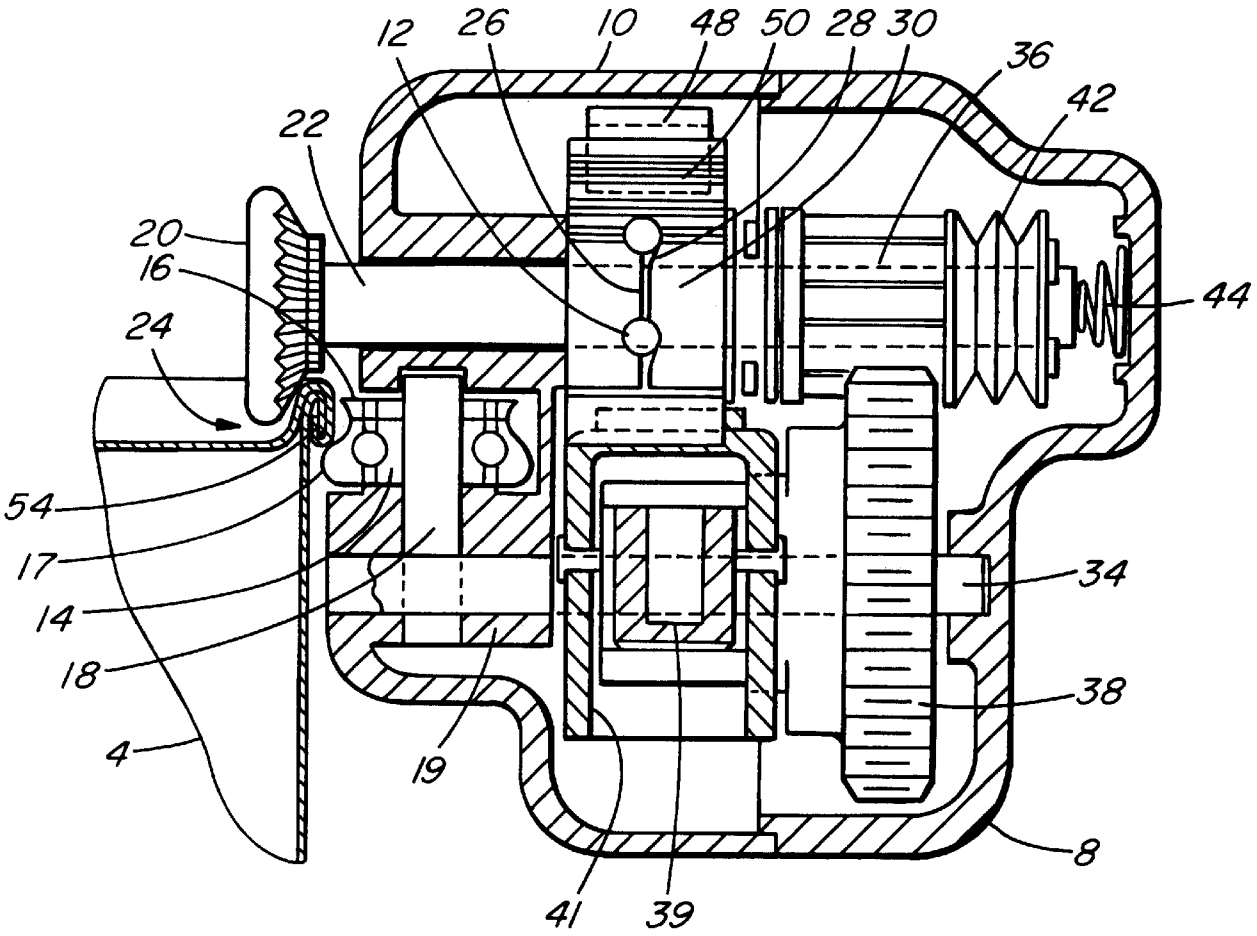
FIG. 3 illustrates a section view taken along section line A—A of FIG. 1.
Figure 4:
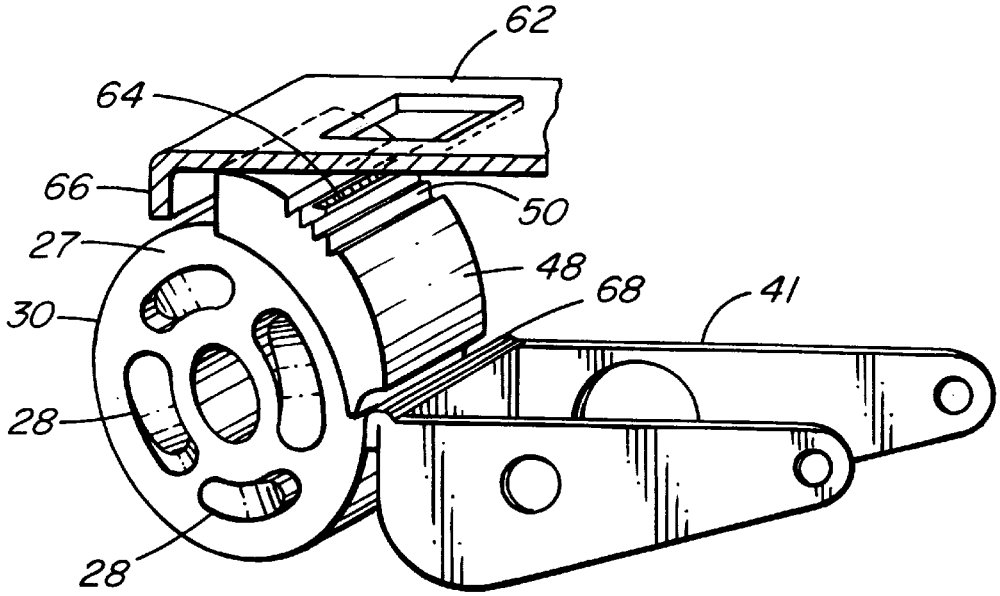
FIG. 4 illustrates a detailed isometric view of the secondary housing with engagement lug and grip teeth and of the manner in which the ratchet gear lever and lug engagement slide interact with the engagement lug and grip teeth of the secondary housing.

The traction wheel 20 is movable towards the cutting wheel 14 to close the gap 24 thereby engaging and locking the top seam 54 of the can, as shown in FIGS. 2, 4 and 5. The gap 24 is closed when the handle 3 and the movable handle 6 are first closed together, after the opener is positioned on the can 4. When a can 4 is so engaged, traction wheel 20 is rotated and the cutting wheel 14 acts to sever (cut) the exterior side of the top seam 54 of the can 4, as is shown most clearly in FIGS. 3 and 5. This top seam 54 cutting action is achieved by the cutting wheel 14 severing the exterior side of the can seam 54 as the traction wheel 20 acts to move the can 4 and seam 54 past the cutting wheel 14.

In the illustrated embodiment, and particularly in FIG. 3, the traction wheel 20 is the wheel that is movable towards cutting wheel 14 and controls the width of gap 24. Cutting wheel 14 is stationary. The movement of wheel 20 is possible due to the traction wheel spindle shaft 22 being slidably mounted within housing 10 and removable housing 8 for axial lateral movement as indicated by the arrow in FIG. 3.

The movement of the traction wheel 20 along the traction wheel spindle shaft 22 in the direction of secondary housing 30 is accomplished by a first thrust surface 26 (see FIG. 3), associated with housing 10 and a spaced, adjacent, second thrust surface 27 formed on a movable secondary housing 30, moving towards one another. The first thrust surface 26, being part of the housing 10, remains stationary with respect to the housing 10 at all times. The second thrust surface 27 is part of movable secondary housing 30 and has disposed in the face thereof four curved grooves 28 with sloping bottoms. These grooves 28 carry therein four steel balls 12 (see FIG. 3). The thrust surfaces 26 and 27 form a type of ball bearing action because they can be rotated relative to each other by pumping the moveable pump handle 6 relative to fixed handle 3. Squeezing the movable handle 6 in the direction of the fixed handle 3 through a series of levers and gears rotates the secondary housing 30 relative to fixed first thrust surface 26, and the balls 12 move downwardly in the grooves 28 and thereby enable the two thrust surfaces 26, 27 to move toward each other to the closed position shown in solid lines in FIG. 3. In doing so, the traction wheel 20 is moved inwardly, that is, towards the cutting wheel 14, as shown by the arrow in FIG. 3. In this way, the gap 24 is closed and the can 4 and can seam 54 are gripped securely for cutting.

FIG. 4 shows, in isometric view, the secondary housing 30, the thrust surface 27 and illustrates in particular the shape of the four curved sloping bottom grooves 28. The first stationary thrust surface 26, which is associated with the housing 10, has a corresponding set of curved grooves or depressions which hold four steel balls 12 as is probably shown most clearly in FIG. 3. By rotating the thrust surface 27 of secondary housing 30, relative to the first thrust surface 26 of housing 10, the four balls 12 ride upwardly or downwardly in the curved sloping bottom grooves 28, which in turn by the degree of protrusion of the balls 12 moves the thrust faces 26 and 27 apart or together, as required. FIG. 4 also illustrates a raised engagement lug 48 on the secondary housing 30. The lug 48 has on the top thereof a parallel series of four grip teeth 50. These teeth 50 are engaged by teeth engagement lip 64 of slide 62, which has a forward lug release finger 66. FIG. 4 also illustrates the ratchet gear lever 41 with its lug engagement lip 68 at the front end adjacent the lug 48.

As seen best in FIG. 1, the moveable pump handle 6 is connected by pump handle lever 40 and 41, ratchet gear 39, pump handle gear 38 and traction wheel gear 36 to traction wheel 20 on spindle shaft 22. Shaft 22 has along part of its length a hexagonal cross-sectional section which freely moves into and out of the hexagonal interior of traction wheel gear 36 to provide a release mechanism. When the shaft 22 is in place in gear 36, the shaft 22 and gear 36 spin together. Alternatively, the shaft can have a key which engages the gear 36. The traction wheel spindle shaft 22 is rotated by pumping the handle 6, relative to fixed handle 3, and via the traction wheel gear 36 and pump handle gear 38 provides a 2:1 mechanical advantage.

As seen in FIG. 3, series of dome spring washers 42 facilitate rotation of the traction wheel 20 and spindle shaft 22 relative to the secondary housing 30. The dome spring washers 42 also serve as a self-adjusting compression system that automatically adjusts for different thicknesses of can seams (see seam 54 in FIG. 3). A spring 44, mounted on the distal end of the traction wheel spindle shaft 22 adjacent the dome spring washers 42 ensures that when the pump handle 6 returns to an open rest position as shown in dotted lines in FIG. 1, the traction wheel 20 will move outwardly under the influence of the spring 44, away from cutting wheel 14. The opener 2 also includes a spring 46 (see FIG. 1) that urges the moveable pump handle 6 to the open position (shown in dotted lines in FIG. 1) when the opener 2 is not in use.

As seen in FIG. 2, U-shaped abutment means 32 guides the movement of the can opener 2 of the present invention about the can 4 and can seam 54 during cutting of the can seam 54. The U-shaped can abutment 32 encloses cutting wheel 14 and traction wheel 20 and by being curved downwardly engages the top surface of the can 4, as shown particularly in FIGS. 2 and 5. The U-shaped abutment means 32 also assists in centring the can opener 2 on the can 4 so that a proper cut of the can seam 54 will always be made.

As shown particularly in section view in FIG. 3, in a preferred aspect of the present invention, the cutting wheel 14 is formed with cutting edge 16 and a shoulder 17 that abuts the exterior underside of the top seam 54 of the can 4 to thereby guide the cutting wheel 14 and hold it in position against can seam 54 as the cutting edge 16 cuts through the exterior of the can seam 54.

As shown in FIGS. 1 and 5, the cutting wheel spindle shaft 18 is preferably mounted at an angle to the vertical. This improves the engagement of the cutting wheel 14 with the can seam 14 and the cutting action. An appropriate angle is about 12.5° from the vertical.

METHOD OF OPERATION OF THE CAN OPENER

The can opener according to the invention is easy to use. The can opener is placed over a can 4 as shown in FIGS. 2, 3 or 5 with the pump handle open. The pump handle 6 is closed against handle 3, and through a series of levers rotates the secondary housing 30. Rotation of housing 30 ensures that the cam surfaces 26 and 27 move the housing 10 to the position shown in FIG. 3 and, in doing so, closes the gap 24 so that it grips the can 4 and the upper can seam 54. This action is explained in more detail in the following discussion.

The moveable handle 6 drives the cutting action of the traction wheel 20 and cutting wheel 14 in the following fashion. Referring to the drawings, FIG. 1 illustrates a side elevation section view of the pump-action can opener 2. FIG. 3 illustrates a section view taken along section line A—A of FIG. 1. The can opener 2 has a stationary handle 3 and a moveable pump handle 6, constructed in the shape of the handle of a pistol. The traction wheel 20 on spindle shaft 22 is connected via secondary housing 30 to the traction wheel gear 36. As explained previously, gear 36 is disconnectable from shaft 22, and is engaged by shaft 22 when a hexagonal portion of shaft 22 penetrates the hexagonal interior of gear 36. These components are all arranged in series on traction wheel spindle shaft 22. The teeth of the traction wheel gear 36 in turn engage with the teeth of a larger pump handle gear 38, to provide a 2:1 mechanical advantage. The pump handle gear 38 is mounted on the extended rear arm 34 of U-shaped can abutment 32. The ratchet gear 39 is mounted adjacent the traction wheel gear 36 on the same U-shaped gear axle 34, (see FIG. 2). Thus the U-shaped abutment arm serves as both an axle 34 for the pump handle gear 38, and the ratchet gear 39, and as a can top stabilizer.

As is probably best visualized in FIGS. 1 and 3, the ratchet gear 39 is advanced in steps by the operator reciprocatingly pumping moveable pump handle 6 relative to stationary handle 3. The ratchet gear 39 is engaged by ratchet gear lever 41, which in turn is connected to pump handle lever 40, which in turn is connected to the upper region of moveable pump handle 6 by pin 37.

The can opener 2 is initially engaged with the seam 54 of the can 4 by placing the traction wheel over the seam 54. Then the movable handle 6 is squeezed once. This action, through the linkage gears, moves ratchet gear lever 41 upwardly. In turn, this moves engagement lip 68 upwardly. Lip 68 abuts the bottom side of lug 48 and moves it to the upper position shown in FIG. 4. This upward movement of lug 48 causes teeth engagement lip 64 of slide 62 to engage one of the grip teeth 50 so on the top of lug 48. Thus lug 48 and housing 30 are held in an upper position as seen in FIG. 3. The initial upward movement of lug. 48 also causes the housing 30 to rotate. This in turn causes the balls 12 to ride downwardly in the curved slope bottom grooves 28 (see FIG. 3). The secondary housing 30 then advances in the direction of the stationary housing (see FIG. 3) and causes traction wheel 20 to close on can seam 54. The can seam 54 is then ready for cutting. By alternatingly closing and opening moveable pump handle 6 relative to stationary handle 3, by clenching and unclenching his or her fist, the operator through pump handle lever 40 and ratchet gear lever 41, ratchet gear 39, pump handle gear 38, and traction wheel gear 36, causes traction wheel 20 to advance around the top seam 54 of the can 4 and in turn causes cutting edge 16 to cut the exterior side of seam 54 of the can 4.

The moveable pump handle 6 is urged to return to the open position as shown in dotted lines in FIG. 1, by coil spring 46, thus assisting the pumping action. A ratchet spring 43, as seen in FIGS. 1 and 2, causes the ratchet gear engaging finger 45 to return to its original position, after it has engaged the teeth of ratchet gear 39 on each forward movement of the pump handle lever 40 and ratchet gear lever 41 caused by closing pump handle 6 in the direction of the stationary handle 3. Thus, the force that the operator applies by clenching his or her fist in closing handle 6 against stationary handle 3, which is the strongest force the human hand can make, causes the various gears to engage with one another and advance the traction wheel 20 around the seam of the can 4 in stepwise manner. Downward movement of pump handle lever 40 and ratchet gear lever 41 are resisted by stop 47.

Once the circumference of the seam 54 of the can 4 has been cut, then the operator is ready to detach the opener 2 from the can 4. The pump-action can opener 2 includes a button release feature. As seen in FIG. 1, a pivotal thumb release button 52 is mounted at the top rear portion of the housing 8, 10 above the stationary handle 3. The release button 52 pivots about a release button pivot pin 56. The moveable pump handle 6 also pivots about the same pivot pin 56. The release button 52 is connected via first release button lever 58 and second release button lever 60 to a lug engagement and release button slide 62. (A forward portion of this slide 62 is illustrated in FIG. 4). The slide 62 is urged to a forward position by a coil spring 61. The forward portion of the slide 62, opposite the release button 52, has on the underside thereof a teeth engagement lip 64 and a lug release finger 66. Teeth engagement lip 64 engages with one of the gripping teeth 50 of secondary housing engagement lug 48 as explained previously, and as seen in FIG. 4. When the operator depresses release button 52, the series of levers 58 and 60 cause the slide 62 to move rearwardly and compress spring 61, thereby releasing the engagement of teeth engagement lip 64 from one of the teeth 50 of secondary housing lug. The rearward movement of the lug release finger 66 engages the forward part of lug 48 and causes lug 48 to move rearwardly (to the right as seen in FIG. 1). Thus, engagement of the lip 64 with one of the teeth 50 is released, the lug 48 returns to a lower position, and it is possible to remove the pump-action can opener 2 from the seam 54 of the can 4.

It should be noted that there is a gap between the lug release finger 66 and the forward end of lug 48. This gap is important to allow some latitude when the teeth engagement lip 64 engages one of the four teeth 50. The four teeth 50 provide versatility to the can opener 2. Each operator of the can opener 2 may not have the same strength, and thus when the can opener 2 is first closed on the seam 54 of the can by the operator squeezing handle 6, any one of the four teeth 50 on the top of lug 48 may be engaged by lip 64. The plurality of teeth 50 take into account and adjust the fact that there will be a difference in hand strengths of the various operators of the can opener 2. The operator with the strongest grip will squeeze harder and the lip 64 will engage a different tooth 50 than a weak operator.

Repairs and replacement of parts for the can opener 2 can be readily made. As seen in FIG. 3, housing 8, which encloses the traction wheel gear 36 and pump handle gear 38, as well as dome spring washers 42 and coil spring 44, can be separated from main housing 10 to enable the parts of the pump-action can opener to be disassembled for repair or replacement.

FIG. 5 illustrates a detail side view of the traction wheel 20 and cutting wheel 14 cutting a top seam 54 of a can 4. As seen in FIG. 5, the traction wheel 20, which rotates on traction wheel spindle shaft 22, along with the forward end of U-shaped can abutment 32, and the U-shaped gear axle 34, at the rear, engages the seam 54 and the top of the can 4. The U-shaped can abutment 32 is curved downwardly so that it descends below the elevation of the upper edge of seam 54, as shown in dotted lines in FIG. 5. It also assists alignment between the can 4 and the traction wheel 20 and cutting wheel 14. As mentioned previously, the cutting wheel 14, with cutting edge 16, which is mounted on cutting wheel spindle shaft 18, which is mounted in cutting wheel block 19, are disposed at an angle to the plane of seam 54, to enhance seam cutting action. By mounting the cutting wheel 14 and cutting edge 16 at an angle, metal shear cutting action of the cutting edge 16 is improved.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A pump-action dual handle can opener operable using one hand comprising:

(a) a housing having a first handle;

(b) a cutting wheel associated with the housing and first handle having a cutting edge for severing an exterior circumferential wall of a seam of a can, said cutting wheel defining a cutting wheel axis which is substantially perpendicular to the lid of the can when the can opener is in position to cut the seam of a can;

(c) a traction wheel associated with the housing and first handle having a gripping surface for engaging an interior circumferential wall of the seam of the can, said traction wheel defining a traction wheel axis which is substantially parallel with the lid of the can when the can opener is in position on the seam of the can;

(d) a releasable look associated with the housing and first handle and having both an unlocked position and a plurality of locked positions, wherein, in each of said plurality of locked positions, said traction wheel is in direct contact with the interior circumferential wall of the seam of the can and said cutting wheel is in direct contact with the exterior circumferential wall of the seam of the can;

(e) a second handle which is movable towards and away from said first handle, said first handle and second handle together forming the shape of the handle of a pistol, and said second handle, when initially moved towards said first handle after the can opener is installed on the seam of the can, actuates said lock in one of said plurality of locked positions, causing said traction wheel to contact the interior circumferential wall of the seam of the can and the cutting wheel to contact the exterior circumferential wall of the seam of the can, and until said lock is released back into its unlocked position, the second handle on subsequent reciprocal movement towards and away from the first handle through a series of levers and gears causing the traction wheel to rotate in incremental steps and advance the traction wheel along the interior circumferential wall of the seam of the can and thereby cause the cutting wheel to rotate and cut the exterior wall of the seam of the can; and (f) a traction wheel gear and a pump handle gear, which have different diameters to thereby provide a mechanical advantage when the second handle is moved towards the first handle.

2. A can opener as claimed in claim 1 wherein the levers of the moveable second handle engage a ratchet wheel when the second handle is moved towards the first handle, and release from the ratchet wheel when the second handle is moved away from the first handle.

3. A can opener as claimed in claim 1 including:

(a) a mechanism for rotatably mounting said traction wheel and said cutting wheel in said housing such that the axes of the traction wheel and the cutting wheel are substantially perpendicular, said wheels being positioned adjacent and spaced apart from each other to define a gap to accept the seam of a can to be opened, one of said wheels being movable towards the other to engage and lock said seam of the can between said cutting wheel and said traction wheel so that said cutting wheel acts to sever an exterior wall of the can seam and said traction wheel acts on the interior of the seam to move said can seam past said cutting wheel;

(b) a first thrust surface associated with said housing and a spaced, adjacent, movable second thrust surface associated with said traction wheel, said first and second thrust surfaces comprising cooperable surfaces rotatable relative to each other and being formed with at least one ball and at least one ball race, said first and second thrust surfaces defining a first position where said can seam is engaged and locked between said cutting wheel and said traction wheel, and a second position where said gap between the cutting wheel and the traction wheel is widened to enable the can opener to be released from the can seam.

4. A can opener as claimed in claim 1 wherein the axis for said cutting wheel and the axis for said traction wheel comprise a pair of shafts which are rotatably mounted in said housing.

5. A can opener as claimed in claim 1 including an abutment member for guiding the movement of said can opener about the can during the cutting operation.

6. A can opener as claimed in claim 5 wherein said abutment member has a downwardly curved U-shape adapted to engage with a top edge of the seam of the can and extend downwardly towards a top lid of the can.

7. A can opener as claimed in claim 1 wherein the axis of said cutting wheel is positioned at an angle with respect to the plane of the top of the can.

8. A can opener as claimed in claim 3 wherein the second thrust surface has thereon a lug projection, the second thrust surface and the lug projection being rotated to a first position when the second handle is initially moved towards the first handle, and said lock engages the lug projection to hold it in the first position, and when the lock is released into its unlocked position, the lug projection is free to move from the first position to a second position.

9. A can opener as claimed in claim 3 including four balls and four ball races, the bottoms of the races being sloped so that the first and second thrust surfaces move towards or away from one another as the balls move along the races.

10. A can opener as claimed in claim 8 wherein the lug projection is moved to the first position by a lever associated with the moveable second handle, wherein a surface of the lug projection has thereon a plurality of grooves, and wherein said lock has a trigger which engages one of said plurality of grooves to provide said plurality of locking positions in respect of said lock.

11. A can opener as claimed in claim 1 wherein the traction wheel gear is engageable with the traction wheel when the moveable second handle is moved towards the first handle.

* * * * *